United States Patent [19]

Regler et al.

[11] Patent Number: 4,733,649

[45] Date of Patent: Mar. 29, 1988

[54] PROCESS AND APPARATUS FOR MULTIPLE LAP CUTTING OF SOLID MATERIALS

[75] Inventors: Dieter Regler, Marktl; Alfred Moritz, Burghausen; Klemens Mühlbauer, Burgkirchen, all of Fed. Rep. of Germany

[73] Assignee: Heliotronic Forschungs- und Entwicklungsgesellschaft fur Solarzellen-Grundstoffe mbH, Munich, Fed. Rep. of Germany

[21] Appl. No.: 709,589

[22] Filed: Mar. 8, 1985

[30] Foreign Application Priority Data

May 22, 1984 [DE] Fed. Rep. of Germany ..... 3419046

[51] Int. Cl.[4] ..... B28D 1/02

[52] U.S. Cl. ..... 125/16 R; 51/65

[58] Field of Search ..... 125/12, 16 R, 16 L; 51/65

[56] References Cited

U.S. PATENT DOCUMENTS

| | | | |
|---|---|---|---|
| 2,831,476 | 4/1958 | Wilson | 125/12 |
| 3,239,914 | 3/1966 | Shirakura | 51/65 |
| 4,105,012 | 8/1978 | Hini | 125/16 R |
| 4,646,710 | 3/1987 | Schmid et al. | 125/16 R |

OTHER PUBLICATIONS

Journal of Physics E (Great Britain), Jan. 1971, vol. 4, pp. 54–56, C. S. Dickinson.

*Primary Examiner*—Harold D. Whitehead

*Attorney, Agent, or Firm*—Burgess, Ryan & Wayne

[57] ABSTRACT

A process and an apparatus for carrying out a process for multiple lap cutting of solid materials, especially those having rectangular or square cross sections, in which the workpiece is subjected, during the cutting operation, to a rotating motion thereby improving the quality of the discs and increasing the cutting efficiency.

8 Claims, 1 Drawing Figure

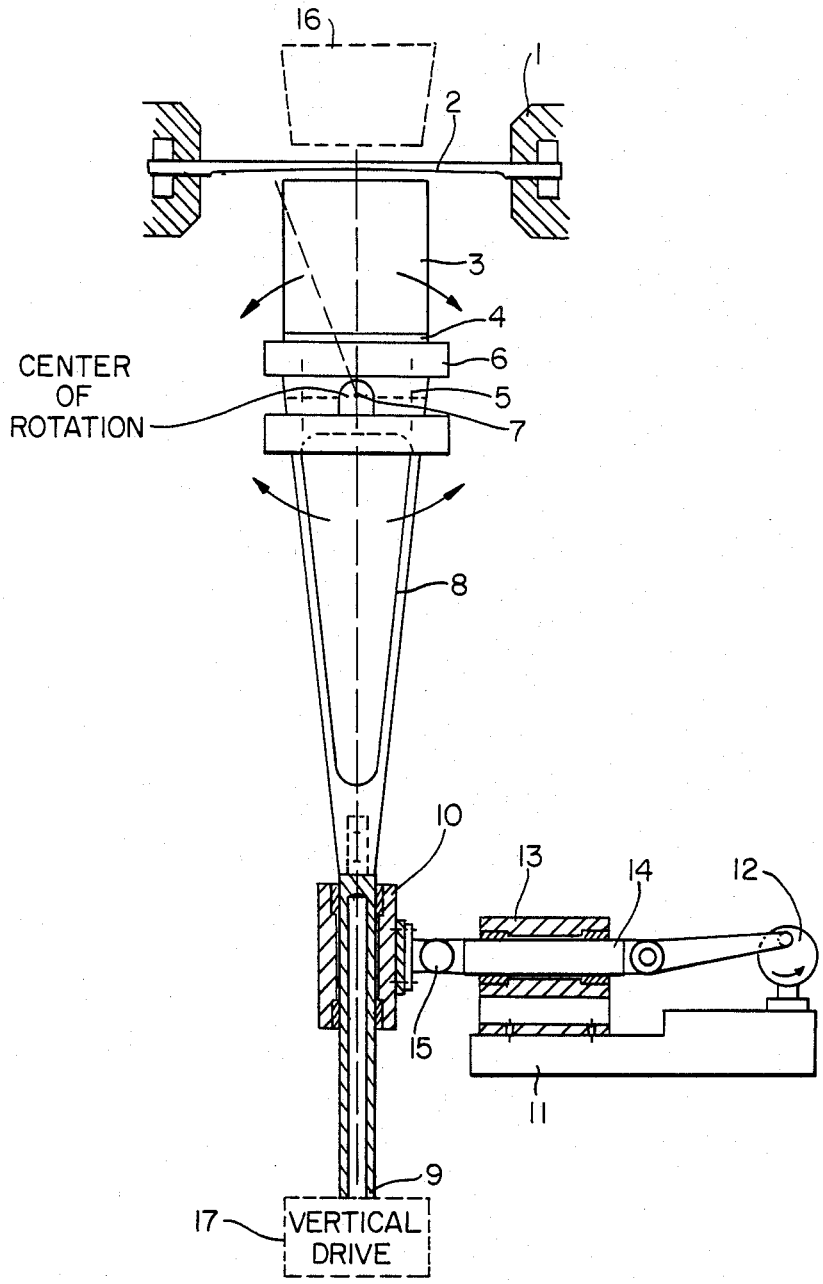
FIGURE

PROCESS AND APPARATUS FOR MULTIPLE LAP CUTTING OF SOLID MATERIALS

The invention relates to an apparatus and process for multiple lap cutting of solid materials, wherein a reciprocatingly moving set of blades, under pressure, cuts downwardly through the solid material, while from the top of the blades, the cutting zone is supplied with a suspension of lapping abrasive.

BACKGROUND OF THE INVENTION

The production of energy by photovoltaic means can only be considered for replacing conventional energy sources which are in many regards disadvantageous when the production costs of solar cells is reduced. Therefore, it is necessary to reduce the cost of every part of the production process form the preparation of the basic material to the finished solar cell. One critical process step is the step in which the basic material, mostly in bar or block form, is sawed to form discs from which the solar cells are made.

The sawing is generally done by two methods: the inner-hole sawing method, wherein the bar is sawed disc by disc, or the multiple lap cutting method wherein the bar is simultaneously divided into a multiplicity of discs.

Multiple lap cutting processes are known, especially for the cutting of silicon or germanium blocks, from German DE-OS No. 20 39 699 and DE-OS No. 27 22 782. In the publications, the blocks under pressure are cut downwardly from above by means of a saw frame reciprocatingly moved at a certain lateral speed. During the cutting operation, a suspension of lapping abrasive is fed from the top of the blades. The cutting suspension can be prepared according to DE-OS No. 27 22 780. The suspension penetrates into the dividing gap, reaching the cutting zone, and finally flowing downwardly, carrying the eroded material away from the cutting zone. However, the discs obtained by these processes, which are capable of high production rates, include, in many cases, fine cracks and cannot be used. Additional process difficulties are caused in the case of workpieces of rectangular cross section, by the impulse attributed to the uneven erosion of the blades, which impulse bears upon the workpiece at the reversal point of the saw frame, and can result in damage such as marginal ruptures (see German patent application P No. 32 47 836.7). In such case, the damaged discs cannot be used.

DDR commercial Pat. No. 67,331, publication date June 5, 1969, discloses a lap cutting process which is stated to improve the surface quality of the discs being cut off by forcing an additional rotating motion upon a workpiece that is immersed in a tub filled with an emulsion of lapping abrasive and reciprocatingly moved over the cutting blades mounted therein. The emulsion of the lapping abrasive covers the cutting blades in the cutting zone of the semiconductive crystal bar, and brings about an improvement in the cutting quality.

The object of the present invention, on the other hand, is to provide a process which reduces losses in yield resulting from mechanical damage to the discs during the cutting operation when cutting solid materials, especially mono- or polycrystalline blocks of semiconductive material such as silicon or germanium.

OBJECTS AND SUMMARY OF THE INVENTION

According to the invention, the damage to the cut discs is reduced by a process for multiple lap cutting wherein a set of blades, reciprocatingly moving under pressure, cuts downwardly through a cutting zone in a cutting plane in a workpiece, the cutting zone is supplied with a suspension of a lapping abrasive from above the cutting portions of the blades, and the workpiece is subjected to a rotating motion about an axis of rotation located beneath the bottom of the workpiece and perpendicular to the cutting plane.

In the process, a distinct reduction of mechanical damage was unexpectedly discovered in the discs produced even though the cutting operation, contrary to the cited DDR commercial patent, is effected by the motion of the set of blades, which progress downwardly through the solid material being cut, and the cutting zone that is at the underside of the blades, is supplied with lapping abrasive from above the blades. One would expect that the rotation of the workpiece would not permit accumulation of the lapping abrasive emulsion in the cutting zone and would provide stronger discharge of the lapping abrasive from the cutting zone with a poorer cutting result.

The process according to the invention can be carried out by modification of the lap cutting machines or reciprocating saws such as described in DE-OS No. 20 39 699 or DE-OS No. 27 22 782. The process of the invention produces especially good results in cutting solid materials in block form that have a rectangular or square cross secton; however, it is also effective in reducing damage in cutting discs having different cross sections such as round bars.

For carrying out the process according to the invention, it is preferred in an oscillating motion, to move the workpiece to both sides of the resting position by an angle of from about 0.1° to 3°, preferably from about 0.7° to 2°. Larger angular ranges, which are possible in principle, generally increase the stress on the material and the cost of the required equipment without substantially improving the operation. With smaller angular ranges, rapid deterioration of the cutting operation occurs. During the cutting operation, the angular range can be kept constant or can be reduced. It is preferred to reduce the angular range as the cutting zone moves through the workpiece.

The frequency of the rotating motion must be coordinated with the reciprocating frequency of the set of blades so as to reduce the occurrence of resonance, since the reciprocating saws used for multiple lap cutting generally comprise extremely complex vibration systems. The occurrence of resonance can be evaluated only with difficulty for specific parameters of each machine. Therefore expediently, the frequency of the rotating motion is empirically adjusted in proportion to the selected operating frequency of the reciprocating saw. For the rotating motion, frequencies will preferably be selected at lower frequencies compared to the frequency of the frame motion even though equal or opposite synchronous operation or higher frequencies are also possible. During the cutting operation, the rotating frequency can be changed or, preferably, it is kept constant. In general, an operating frequency of about 0.2 to 0.4 times the value of the saw frame frequency is preferred.

The axis of rotation about which the rotating motion of the workpiece takes place must meet two criteria. The axis of rotation should be as perpendicular as possible to the cutting plane, that is, the plane through which the cut of the workpiece progresses, so as to make possible a relative motion without tilt between the set of blades and the workpiece and to keep the cutting losses small. It must also be located below the bottom margin of the workpiece so that the rotation axis does not pass through the cutting edge of the blades during the cutting operation.

The spatial shape described by the workpiece during the rotating motion corresponds to a section of a hollow cylinder in which the outer radius is defined by the maximum distance between the outer edge of the workpiece and the axis of rotation and the inner radius is defined by the distance between the bottom edge of the workpiece and the axis of rotation.

It is preferred to keep the inner radius small, that is, the rotation axis should be close to the bottom of the workpiece, for example, within or just beneath the workpiece carrier upon which the workpiece is secured. In the case of workpieces in block form having a rectangular or square cross section, the progressive cutting operation provides a marked reduction in the working length of the blades combined with reduction of blade impact at the reversal points.

It is preferred to locate the axis of rotation so that the rotating motion of the center of gravity of the cross-section of the workpiece has mirror symmetry. This can be obtained by making the axis of rotation lie vertically, directly beneath the center of gravity of the cross-section of the workpiece. If several workpieces such as two adjacent silicon blocks are cut into discs in one step, the common center of gravity of the cross-section thereof should be positioned vertically above the axis of rotation.

BRIEF DESCRIPTION OF THE DRAWING

The FIGURE is an elevational view, partly in section, of an embodiment of the invention for carrying out the process according to the invention.

DETAILED DESCRIPTION OF A PREFERRED EMBODIMENT

Referring to the FIGURE in detail, a set of blades 2 mounted in a tenter frame 1 executes, during a cutting operation, a reciprocating motion. During such cutting operation, a workpiece 3, which can be a block of silicon or germanium, is pressed upwardly from below against the set of blades 2 by a vertical drive 17, although alternatively or in addition, blades 2 can be pressed downwardly. In other words, blades 2 effectively work downwardly into the workpiece 3. A lapping abrasive supply means 16 shaped, for example, as an oscillating nozzle, supplies a lapping abrasive to the cutting zone from a position above the set of blades.

The workpiece 3 is conveniently secured by gluing, or the like, to a cutting base 4 made, for example, of glass or ceramic, and which is connected with a workpiece carrier 5 by means of a workpiece mounting 6. The thickness of cutting base 4 is preferably selected so as to eliminate contact of the blades with workpiece carrier 5, even at the end of the cutting operation, when the base has already been partly cut into.

Within workpiece carrier 5, and beneath the workpiece mounting 6 thereof, there is a rotation shaft or axis 7, which is positioned directly beneath the center of gravity of the cross-section of workpiece 3, thereby allowing a mirror symmetric rotating motion.

A connecting fork 8 is connected to the underside of workpiece carrier 5 and, at its lower end, carries a feed bar 9, which is connected to a pivot drive 11 by means of a bearing 10, such as a friction bearing. The pivot drive 11 comprises a drive unit such as a variable speed electric motor with an adjustable eccentric disc 12. Other drives such as hydraulic, pneumatic or electromagnetic can also be used. A power transmission comprises a driving rod 14 supported by friction bearings 13, connected at one end with disc 12 and connected at its opposite end with the friction bearing 10 through a link 15.

The reciprocating motion of the driving rod 14 produces a rotating motion at the feed bar 9, and thus advances the workpiece 2. The advantage of such an arrangement is that by feeding the workpiece upwardly, the distance between the axis of rotation of shaft 7 and the contact point of the pivot drive on the feed bar 9 constantly increases as the cutting operation progresses. Correspondingly, the angle at which the workpiece is moved from the resting position during the rotation operation decreases and the working length of the set of blades decreases. Therefore, there occurs at the terminal area of the cut a uniform change in the unstressed area at the lower edge of the blades. The impact of the blades at the reversal points is reduced, which reduces the stepped structure at the end of the cut that results from the uneven stressing of the blades and causes damage to the divided discs.

At the beginning of the cutting process, according to the invention, the workpiece, which is secured by a cutting base on the workpiece carrier, is preferably first placed in rotating motion with the desired frequency and deviation. The workpiece is then brought into contact, under low pressure, with a constant supply of the lapping abrasive suspension, and with the set of blades reciprocatingly moving at the working frequency. When the cutting edges have been completely shaped, which means that during the whole rotation process all blades have been brought into a friction-producing contact with the surface of the workpiece to be cut, the pressure is finally increased to the intended working pressure which is generally determined by the equipment. It is also possible to have the workpiece at rest at the beginning of the cutting operation and to gradually begin the reciprocating rotation process only toward the end of the starting phase and increasing it to the desired working frequency and deflection. Thereafter, the cutting operation can be carried to the end under the conventional and already known process parameters, which are generally determined by the apparatus, for example, with regard to working pressure stroke, saving frequency, or the type and amount of lapping abrasive fed. By the additional rotation of the workpiece, the cutting efficiency can be increased and the quality of the discs obtained improved in comparison to lap cutting processes carried out under otherwise identical conditions.

The process according to the invention is especially suited to the cutting of semiconductor materials like silicon, germanium, II-V-compounds such as gallium arsenide or indium phosphide, oxidic materials such as sapphire, spinel or ruby, but also of relatively soft materials, such as hexagonal boron nitride. It can be used advantageously for cutting workpieces having rectangular or square cross sections.

EXAMPLE

In a commercially available reciprocating saw (Meyer & Burger, Steffisburg, Type GS2) equipped with an apparatus corresponding to the FIGURE for rotating the workpiece, a block of polycrystalline silicon of columnar structure (100×100×160 mm) was cemented on a glass cutting base about 9 mm thick. The center of gravity of the workpiece was vertically positioned above the axis of rotation and the latter perpendicular to the cutting plane determined by the set of the blades. The distance between the center of the rotation axis and the bottom margin of the workpiece was about 50 mm. The workpiece was rotated through a deflection from the rest position of 0.4° or a total of 0.8°, at a frequency of about 250 strokes per minute.

The set of blades comprised 185 blades (thickness 0.20 mm, height 6.3 mm, spacing between blades 0.6 mm, blade length 262 mm) which moved at 750 strokes per minute and a blade stroke length of 72.5 mm.

The rotated workpiece was pushed upwardly and pressed with a light pressure of 0.1 N/blade against the oscillating set of blades. After all the blades had contacted the silicon block, the pressure was gradually increased to 2.1 N/blade. During the cutting operation, boron carbide (particle-size distribution of 20 to 40 μm) suspended in a mineral oil fraction having a viscosity of 2 mPa s (1 part by weight mineral oil : 1 part by weight boron carbide) was fed as lapping abrasive from the top of the set of blades by means of an oscillating nozzle.

After the complete cutting of the silicon block, the rotating motion thereof and the reciprocating motion of the set of blades were stopped. The 184 discs obtained showed no cutting damage. The cutting operation lasted 2 hours. This corresponds to a cutting performance of 0.9 $cm^2$/minute/blade.

By comparison, a silicon block of the same size was sawed into discs under the same conditions but without the rotating motion. Of the 184 discs obtained, more than 50% contained cutting damage. The whole cutting operation lasted 3.5 hours; the cutting performance was only 0.5 $cm^2$/minute/blade.

What is claimed is:

1. A process for multiple lap cutting of a solid workpiece having a substantially flat surface, comprising the steps of:

reciprocatingly moving a set of blades;

providing relative movement of said set of blades and said workpiece toward each other such that said set of blades, under pressure, initially cuts said substantially flat surface and then cuts downwardly through a cutting zone in a cutting plane in said workpiece;

supplying said cutting zone with a suspension of a lapping abrasive from above the blades; and subjecting the workpiece to an oscillating motion about an axis of rotation located beneath the workpiece and perpendicular to the cutting plane such that said oscillating motion is in the range of 0.1°–3° in each direction from a resting position.

2. A process according to claim 1, further comprising the step of reducing the oscillating angle of said workpiece during the progressing cutting operation thereof.

3. A process according to claim 1, further comprising the step of reducing the oscillating angle of said workpiece during the progressing cutting operation thereof.

4. A process according to claim 1, wherein said oscillating motion of the center of gravity of said workpiece has a mirror symmetry.

5. A process according to claim 1, wherein said step of providing relative movement includes the step of moving said workpiece upwardly toward said set of blades so that said set of blades cuts downwardly through said cutting zone.

6. Apparatus for multiple lap cutting of a solid workpiece having a substantially flat surface, comprising:

workpiece carrier for supporting said workpiece and;

a reciprocating movable set of blades positioned above said workpiece for initially cutting said substantially flat surface and then cutting downwardly through a cutting zone in a cutting plane in said workpiece;

lapping abrasive supply means positioned above said set of blades for supplying said cutting zone with a suspension of a lapping abrasive; and means for oscillating said workpiece carrier about an axis of rotation thereof located below said workpiece and perpendicular to the cutting plane such that said oscillating motion is in the range of 0.1°–3° in each direction from a resting position.

7. An apparatus according to claim 6, further including a pivot drive connected to said workpiece carrier and subjected to a reciprocating motion for producing the oscillating motion of said workpiece carrier.

8. An apparatus according to claim 6, further including means for moving said workpiece upwardly toward said set of blades.

* * * * *